US008033975B2

(12) United States Patent
Wiklund

(10) Patent No.: US 8,033,975 B2
(45) Date of Patent: Oct. 11, 2011

(54) FOLDING UNIT AND METHOD OF FOLDING CORRUGATED CARDBOARD SHEET

(75) Inventor: Lennart Wiklund, Örebro (SE)

(73) Assignee: Berg Industries AB, Stockholm (SE)

( * ) Notice: Subject to any disclaimer, the term of this patent is extended or adjusted under 35 U.S.C. 154(b) by 469 days.

(21) Appl. No.: 11/991,084

(22) PCT Filed: Sep. 1, 2006

(86) PCT No.: PCT/SE2006/001009

§ 371 (c)(1),
(2), (4) Date: Mar. 18, 2009

(87) PCT Pub. No.: WO2007/027142

PCT Pub. Date: Mar. 8, 2007

(65) Prior Publication Data

US 2009/0264271 A1 Oct. 22, 2009

(30) Foreign Application Priority Data

Sep. 2, 2005 (SE) ..... 0501943

(51) Int. Cl.
*B31B 5/36* (2006.01)
*B31B 1/58* (2006.01)

(52) U.S. Cl. ..... 493/438; 493/72; 493/182; 493/358; 493/441

(58) Field of Classification Search ..... 493/69–72, 493/180–183, 357, 358, 423, 436, 438, 440, 493/441, 446–448
See application file for complete search history.

(56) References Cited

U.S. PATENT DOCUMENTS

| | | | | |
|---|---|---|---|---|
| 715,620 | A * | 12/1902 | Staude | 493/277 |
| 3,266,391 | A | 8/1966 | Lopez | |
| 3,992,982 | A * | 11/1976 | Huiskes | 493/295 |
| 4,187,769 | A * | 2/1980 | Bullock | 493/438 |
| 4,614,512 | A | 9/1986 | Capdeboscq | |
| 5,092,827 | A * | 3/1992 | McAdam et al. | 493/179 |
| 5,114,392 | A * | 5/1992 | McAdam et al. | 493/179 |
| 5,716,314 | A | 2/1998 | Lauderbaugh | |
| 5,800,329 | A | 9/1998 | Fager et al. | |
| 7,201,580 | B2 * | 4/2007 | Ho et al. | 434/219 |
| 7,664,717 | B2 * | 2/2010 | Jenkins et al. | 706/45 |
| 7,708,679 | B2 * | 5/2010 | Cailloux et al. | 493/401 |
| 7,818,164 | B2 * | 10/2010 | Wood et al. | 704/5 |

FOREIGN PATENT DOCUMENTS

| | | |
|---|---|---|
| EP | 0420385 | 4/1991 |
| WO | 00/76885 | 12/2000 |

* cited by examiner

*Primary Examiner* — Hemant M Desai
(74) *Attorney, Agent, or Firm* — Harness, Dickey & Pierce, P.L.C.

(57) ABSTRACT

A folding unit for corrugated cardboard sheets, the folding unit comprising an inlet and an outlet, a pair of parallel and laterally dispiaceable folding beams, a pair of folding rules arranged under respective folding beams, a par of folding rods fixedly positioned outside respective folding rules and at angle to the respective folding rules, a pair of folding belts arranged under and cooperating with a respective pair of folding rules, a means for supplying and folding two outermost panels of the corrugated cardboard sheet from 0°-90° at the inlet of the folding unit and 90°-180° at the outlet of the folding unit, a pair of wheel stands engaged with respective folding belts, a means for adjusting an angle of said wheel stands to ihe associated conveying belt, and a means for fine adjustment of the angular settings of the wheel stands.

9 Claims, 5 Drawing Sheets

FOLDING UNIT AND METHOD OF FOLDING CORRUGATED CARDBOARD SHEET

This application is a 371 of PCT/SE2006/001009 filed on Sep. 1, 2006.

BACKGROUND

1. Field

The present invention relates to a folding unit for corrugated cardboard sheets in inline production of corrugated cardboard boxes, comprising a pair of parallel and laterally displaceable folding beams each with an endless conveying belt, which folding beams extend from the inlet of the folding unit to the outlet of the folding unit, a pair of folding rules which are arranged under the respective folding beams and which extend from the inlet of the folding unit and towards, but not all the way to, the outlet of the folding unit, a pair of folding rods fixedly positioned outside the respective folding rules and at angle to the respective folding rules, said folding rods being arranged in the folding unit front portion, seen in the conveying direction of the corrugated cardboard sheets, a pair of folding belts which are arranged under and cooperate with a respective folding rule and extend from an associated guide roller with a vertical shaft at the terminal end of the folding rods in the conveying direction to an associated guide roller with a horizontal shaft substantially adjacent to the outlet, and a pair of wheel stands which are each engaged with the respective folding belts in a position in the conveying direction of the corrugated cardboard sheets after the terminal end of the folding rules and substantially adjacent to the respective folding beams, whereby a corrugated cardboard sheet supplied at the inlet of the folding unit is grasped by the pair of conveying belts and conveyed along the folding rules and the two outermost panels of the corrugated cardboard sheet being successively folded from 0° to 90° by the respective folding rods in cooperation with the associated folding rule, after which each panel folded 90° is engaged with the associated folding belt and the folding rule cooperating with said folding belt for continued folding and then leaves the associated folding rule to be contacted with the associated wheel stand and is finally delivered from the pair of guide rollers with a horizontal shaft, the panels folded 180°, at the outlet.

The invention also relates to a method of folding corrugated cardboard sheets in inline production of corrugated cardboard boxes, comprising the steps of intermittently feeding corrugated cardboard sheets into a folding unit during application of glue; in the folding unit first portion, seen in the conveying direction of the corrugated cardboard sheet, successively folding the two outermost panels of the corrugated cardboard sheet from 0° to 90° by means of a pair of folding rules and a pair of folding rods cooperating with the same; in the folding unit second portion, seen in the conveying direction of the corrugated cardboard sheet, successively folding the two outermost panels of the corrugated cardboard sheet from 90° to 180° by means of a pair of folding belts and said pair of folding rules as well as a pair of wheel stands, by means of which the angle of each folding belt to the horizontal plane is set, and by means of a guide rod guiding the folded corrugated cardboard sheet between a pair of rolls for gluing the glue flap of one folded panel to the other folded panel.

2. Description of the Related Art

Modern production of corrugated cardboard boxes takes place in what is referred to as inline machines. These machines are characterised in that all operations occur in line in one and the same machine. Corrugated cardboard sheets or blanks, which are adjusted to the format of the intended boxes, are intermittently fed one by one by means of a feeding unit in the inline machine.

After that the sheets are printed in one or more printing units which are located after the feeding unit. Then follow scoring, slitting and cutting of the glue flap which take place in the slitting unit of the machine. The next operation is optional punching of air holes, handle holes or any other punching depending on the construction of the boxes. This takes place in what is referred to as the punching unit. The folding unit is positioned after the punching unit. In the folding unit, glue is applied to the glue flap of the sheet, after which 180° folding of the outer panels of the sheet takes place. The glue flap is glued to the outer part of the panel on the opposite side of the sheet.

SUMMARY OF THE INVENTION

With reference to FIG. 1 in the drawings, a sheet of corrugated cardboard 18 is illustrated, which has passed through the feeding unit, printing unit, slitting unit and punching unit of the inline machine and is to be supplied to the folding unit in the direction indicated by arrow 15. The corrugated cardboard sheet 18 is then completely flat, that is unfolded, and provided with opposite slits 50 and intermediate fold lines 53 along which the corrugated cardboard sheet is to be folded in the folding unit. The corrugated cardboard sheet 18 has previously being provided with punched handle holes 51 and printed images 52, when required. The fold lines 53 between the pair of slits 50 and grooves 54 transversely to the fold lines 53 will be used in a subsequent raising of the corrugated cardboard box (not shown). In the embodiment illustrated, the corrugated cardboard sheet 18 consists of two outer panels 55, 56 and two inner panels, 57, 58. In the folding unit, the outer panels 55, 56 are folded 180° along the associated fold lines 53 so as to be made to contact the inner panels 57, 58, a glue flap 59 of one outer panel 55 being glued to the other outer panel 56. In this state, the folded corrugated cardboard sheet 18 is made up into a bundle with a plurality of identical, folded corrugated cardboard sheets to be transported to a receiver.

The accuracy in folding is an important quality criterion for corrugated cardboard boxes. The geometry of the final product/box is directly related to the folding accuracy. Raising and filling machines require a high degree of accuracy to function without problems. Correct folding means that the panels are folded parallel to each other and that the gap width of the slits 50 is uniform. Variations in gap width between the boxes are undesirable and may cause problems when raising, filling and sealing the boxes. Differences in gap width between the bottom and top of the boxes are referred to as fish tailing and may cause difficulties when raising, filling and sealing the boxes. A crucial feature for folding with great accuracy is also that the gap width varies minimally from box to box and that individual boxes in a run do not exhibit any fish tailing.

The accuracy in folding of the corrugated cardboard boxes is determined by a number of factors. Straight feeding and straight conveying of the sheets through the entire machine is a condition for high precision in folding. The crease notches or fold lines, which are formed in the slitting unit of the machine, must be optimally designed with sufficient marking, without the paper layers of the corrugated cardboard breaking. Use of an ever increasing variation of corrugated cardboard grades, and in particular adding an ever increasing amount of recycled fibres in the paper grades, combined with demands for increasing folding accuracy, render this condition more and more critical.

As the sheets reach the folding unit of the machine, the sheets must be conveyed straight, the crease notches must be optimal and absolutely parallel in the correct position on the sheet, and the sheet must be conveyed absolutely straight over the entire folding distance. All these criteria must be satisfied to ensure folding with great accuracy. In the folding unit, the folding movement of the outer panels of the sheet must take place in an optimal manner, which means that the folding movement is controlled to be as smooth as possible and that the folding distance thus is utilised optimally. The longer the folding distance, the better conditions for a smooth folding movement. However, there are practical limits to the length of the folding distance for reasons of cost and space. It is therefore important for the length of the available folding distance to be used in an optimal manner. Folding is performed, inter alia, by means of folding belts (cf. FIG. 7) and the contact surface of the turned folding belts is concentrated to the front edge of the outer panels of the corrugated cardboard sheets in folding. A matter of vital importance in this context is not to subject the outer panels of the boxes to undesirable twisting loads during the folding sequence. This is the immediate cause why as smooth a folding movement as possible is desired and the length of the folding distance thus is optimally utilised.

The production in an inline machine is characterised by shorter and shorter series of box blanks. The changeover times of the machines will therefore have an increasing effect on the productivity of the machines. In modern inline machines, improved automatic systems are desired for setting the machines. The invention is an essential part in this development while at the same time it allows improved quality of the corrugated cardboard boxes by greater accuracy in folding. The setting of the folding movement was previously left to the experience and accuracy of the operator by many of the settings being manual. The automatic system now allows the machine to be set for an automatic folding movement depending on the size and geometry of the boxes.

An object of the present invention thus is to provide a folding unit for corrugated cardboard sheets in inline production of corrugated cardboard boxes, resulting in greater accuracy in folding of the corrugated cardboard sheets.

Another object of the invention is to provide a folding unit for corrugated cardboard sheets which are to be used for corrugated cardboard boxes, allowing monitoring of setting and fine adjustment of folding without the operation of the folding unit having to be stopped.

A further object of the invention is to provide a folding unit for folding (corrugated) cardboard sheets in an inline machine, in which the setting of the different components of the folding unit occurs from a driving and setting console which also controls other units in the inline machine, based on dimension and property data of the corrugated cardboard sheet input into the console.

According to the present invention, these objects are achieved by a folding unit as stated by way of introduction, which is characterised in that each wheel stand comprises an attachment, which is fixedly attached to the associated folding beam and in which at least one guide plate is fixedly attached perpendicular to the folding beam, at least one wheel which is rotatably supported by a support, which by means of a pair of separate guide pins is turnably suspended from a pair of arcuate slots in said guide plate, and an actuator, whose one end is turnably attached to the attachment and whose other end is turnably attached to the support, the angle of said wheel to the associated conveying belt being adjusted by means of the actuator.

A method for use of the folding unit according to the invention is characterised by the step of monitoring the final folding of the two panels during folding and, when required and in operation, finally setting the angle of each folding belt by means of said wheel stands by remote control of the wheel stands from a driving and setting console.

Further developments of the invention are evident from the features as defined in the dependent claims.

BRIEF DESCRIPTION OF THE DRAWING

A preferred embodiment of the invention will now be illustrated by way of example and with reference to the accompanying drawings, in which

FIGS. 4-7 illustrate in cross-section transversely to the conveying direction of the corrugated cardboard sheet how the supplied, unfolded corrugated cardboard sheet is successively folded in the folding unit; of which FIG. 4 is a section along line I-I in FIG. 2;

FIG. 5 is a section along line II-II in FIG. 2;

FIG. 6 is a section along line III-III in FIG. 2; and

FIG. 7 is a section along line IV-IV in FIG. 2;

DETAILED DESCRIPTION OF THE INVENTION

Figure 2:
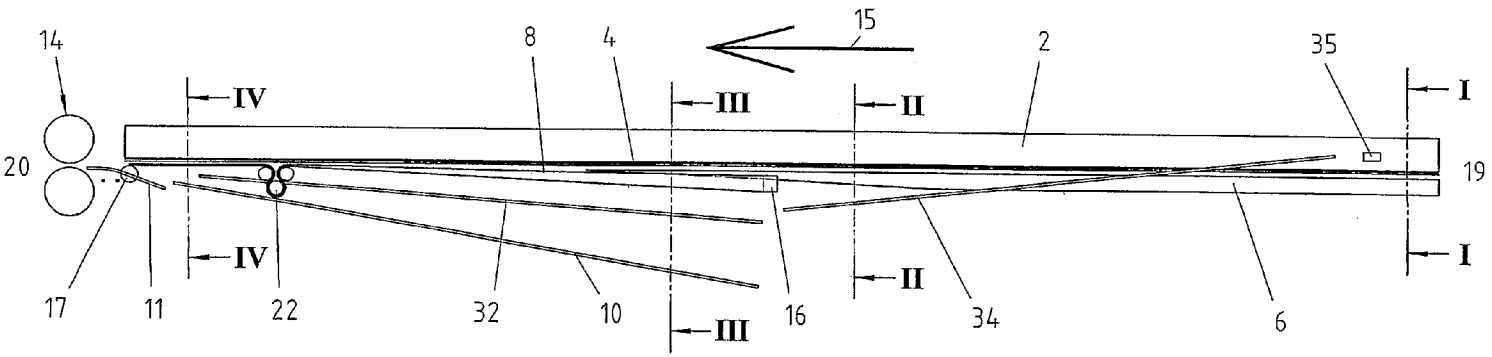
FIG. 2 is a side view in the longitudinal direction and schematically illustrates the construction of the folding unit.
Figure 3:
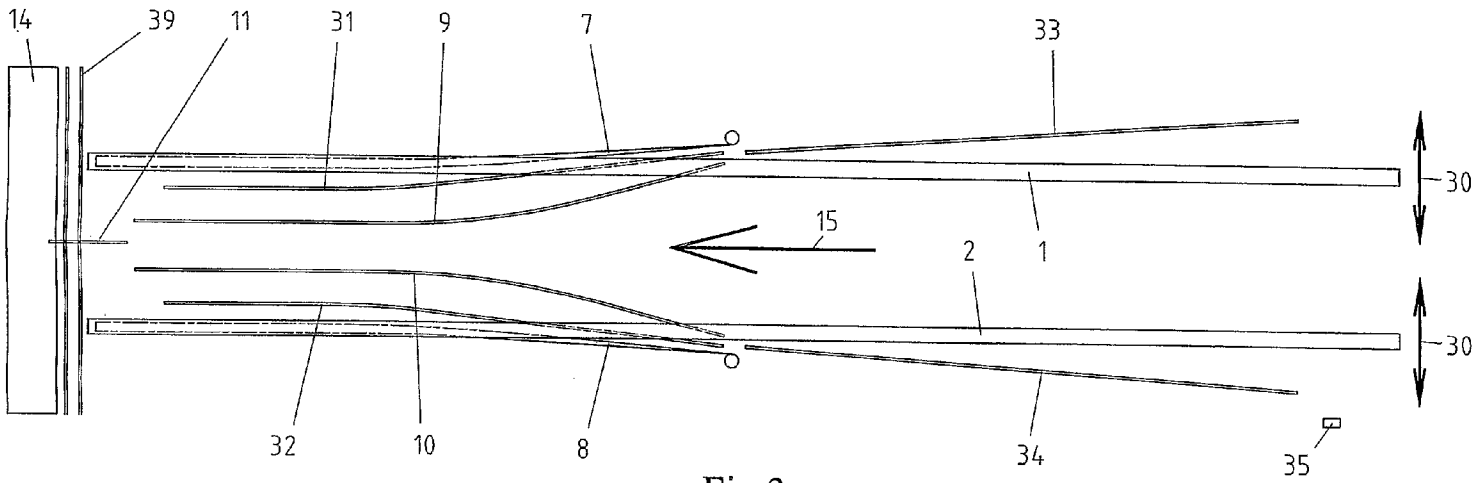
FIG. 3 is a top plan view in the longitudinal direction of the folding unit and schematically illustrates the construction of the folding unit.

With reference first to FIGS. 2 and 3, which schematically illustrate the construction of the folding unit, the folding unit comprises a pair of parallel, right-hand and left-hand folding beams 1,2, which extend continuously from the inlet 19 of the folding unit, that is where the corrugated cardboard sheets 18 are supplied to the folding unit, to the outlet 20 of the folding unit, where the corrugated cardboard sheets 18 are supplied to a pair of rolls 14 or some other device connecting the outer panels 55, 56 of the corrugated cardboard sheet or box blank to each other, as will be discussed in more detail below. The folding beams 1, 2 are movably supported on frames (not shown) of the base plate and can be moved sideways, that is transversely to the conveying direction 15 of the corrugated cardboard sheets 18, by means of associated actuators (not shown), as schematically illustrated in FIG. 3 and indicated by arrows 30 in this figure. The actuators are, for example, a pair of hydraulic cylinders which are attached to the respective frames and folding beams, as will be easily realised by a person skilled in the art.

The folding beams 1, 2 are preferably box-shaped and connected to a respective suction source, for instance a fan (not shown), to generate a vacuum in the folding beams. Through grooves or slits extend in the underside of the folding beams, and a right-hand and a left-hand conveying belt 3, 4 extend adjacent to the underside of the folding beams 1, 2 and along the underside of the folding beams from the inlet 19 of the folding unit to its outlet 20. The conveying belts 3, 4 are endless and extend between a driven and an undriven guide roller, as is known to a person skilled in the art. The conveying belts 3, 4 are formed with a plurality of through holes, the corrugated cardboard sheets 18 adhering to the conveying belts by means of the vacuum in the folding beams 1, 2 and being safely conveyed through the folding unit in the conveying direction 15, cf. FIG. 7.

A right-hand and a left-hand folding rule 5, 6 are arranged under each folding beam 1, 2 and extend along the respective folding beams and under the conveying belts 3, 4 from the inlet 19 of the folding unit and towards, but not all the way to, the outlet 20 of the folding unit, as will be explained in more detail below. The folding rules 5, 6 are laterally displaceable together with the associated folding beam 1, 2. The minimum box size, that is the minimum width of the corrugated cardboard sheet 18 and in particular the panels 57, 58, is directly dependent on the width of the folding beams 1, 2 and how close the folding beams can be moved together transversely to the conveying direction 15.

In the front portion or half of the folding unit in the conveying direction, a right-hand and a left-hand folding rod 33, 34 are fixedly arranged outside, and in cooperation with, the respective folding rules 5,6. The folding rods 33, 34 extend from a point above and on the outside of the respective folding rules 5, 6 to a point substantially in the same vertical plane as and vertically below the associated folding rule 5, 6, cf. FIGS. 4 and 5.

At the inlet 19 of the folding unit, outside and above one folding rule (5) and in the conveying direction 15 in front of its associated folding rod (33), a glue nozzle with adjusting means 35 is positioned, the position of the glue nozzle being adjusted to the position of the glue flap 59 of the fed corrugated cardboard sheet 18.

Corrugated cardboard sheets 18 are intermittently supplied one by one at the inlet of the folding unit, grasped by the pair of conveying belts 3, 4 and conveyed along the folding rules 5, 6. Glue from the glue nozzle 35 is first applied to the glue flap 59 of the corrugated cardboard sheet, and after that the outer panels 55, 56 of the corrugated cardboard sheet 18 are caught by the folding rods 33, 34 which in cooperation with the respective folding rules 5, 6 successively fold the outer panels, along their fold lines 53, from 180° (flat corrugated cardboard sheet) to 90° as will be seen in FIGS. 4 and 5.

After the above-mentioned terminal point or end of the folding rods 33, 34 in the conveying direction 15, a right-hand and a left-hand endless folding belt 7, 8 are arranged under and in cooperation with the respective folding rules 5, 6. Each folding belt 7, 8 extends from an associated guide roller 16 with a vertical shaft at said terminal point of the respective folding rods 33, 34 to an associated guide roller 17 with a horizontal shaft substantially adjacent to the pair of rolls 14, see FIG. 2. The folding belts 7, 8 are thus turned from a vertical orientation adjacent to the guide roller 16 to a horizontal orientation adjacent to the guide roller 17. The folding belts 7, 8 cooperate with the respective folding rules 5, 6, whose outer surface follows the turning of the folding belts in the conveying direction 15 from an angle of 90° to the inner panel 57, 58 of the corrugated cardboard sheet 18 which decreases towards the terminal point of the folding rules in the conveying direction which is positioned approximately halfway between the guide rollers 16 and 17, cf. FIGS. 5, 6 and 7. In the conveying direction 15 after said terminal points of the folding rules 5, 6 and the guide rollers 17, a left-hand and a right-hand wheel stand 22, 23 are attached to the associated folding beam 1, 2 in engagement with the respective folding belts 7, 8, as will be discussed below.

Figure 6:
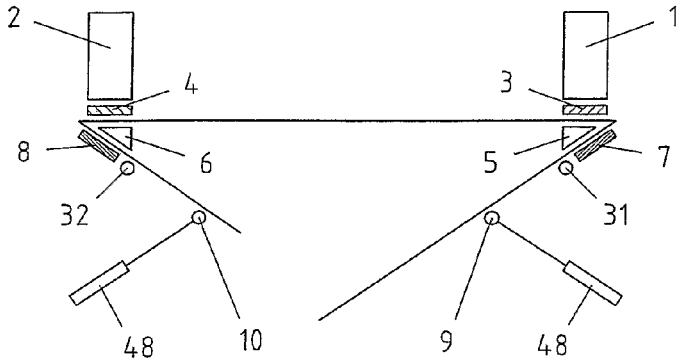

Preferably the folding unit also comprises a right-hand and a left-hand support rod 31, 32, which are attached by means of an associated arm 49 to the respective folding beams 1, 2 and which have essentially the same extent in the conveying direction 15 as the folding belts 7, 8. The support rods 31, 32 serve to support the outer panels 55, 56 which are folded and, due to their flexibility, take an angle or position in the vertical direction relative to the inner panels 57, 58 of the corrugated cardboard sheet which is favourable for the folding of the panels 55, 56 and which is adjusted to the turning angle of the folding belts 7, 8 in the conveying direction 15. As shown in FIG. 6, the support rods 31, 32 are arranged inside the pair of folding belts 7, 8.

The folding unit advantageously also comprises a right-hand and a left-hand rod-shaped panel support 9, 10, preferably double curved, which have substantially the same extent in the conveying direction 15 as the folding belts 7, 8 (and the support rods 31, 32), see FIG. 2, and which by the associated actuator 48 preferably in the form of hydraulic cylinders, see FIG. 6, can be pivoted from an inactive position at the bottom of the base plate (not shown) to an active position inside the pair of support rods 31, 32, see FIG. 6, in order to support, when required, broad outer panels 55, 56 that are being folded. The inline machine discussed by way of introduction is programmed in such a manner in its driving and setting console 21, which is schematically presented in FIG. 3 and which will be discussed in more detail below, that each panel support 9, 10 is automatically raised to a working position if the distance between the folding beams 1, 2 is sufficient and if necessary. The panel supports 9, 10 are raised individually, which means that for certain corrugated cardboard sheets 18, no panel support or only one or the panel supports 9, 10 is raised, depending on the distance between the folding beams 1, 2 and the ratio of the widths of the panels 55-58. For accuracy when folding large corrugated cardboard sheets 18, the panel supports 9, 10 have been found to have a very favourable effect.

Figure 8:
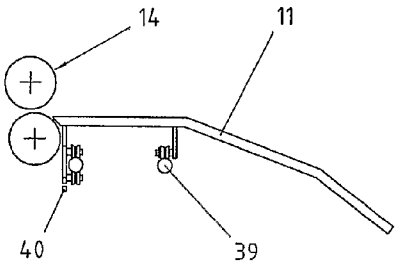
FIG. 8 is a longitudinal section and schematically illustrates the guide rod movably arranged on a shaft by means of an actuator and positioned in front of the pair of rolls.
Figure 1:
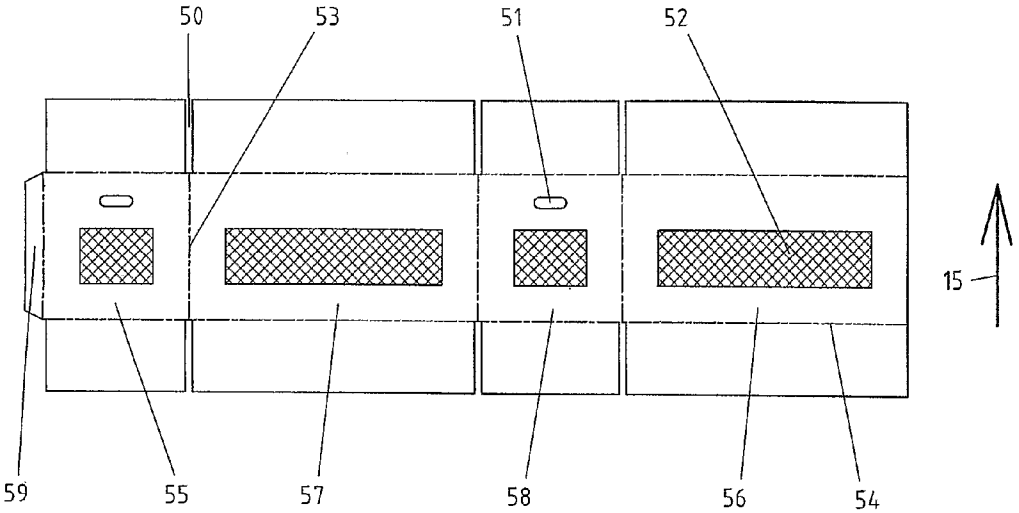
FIG. 1 is a top plan view of a sheet of cardboard or corrugated cardboard which is to be folded to a box blank, folded in two, for subsequent raising.
Figure 7:
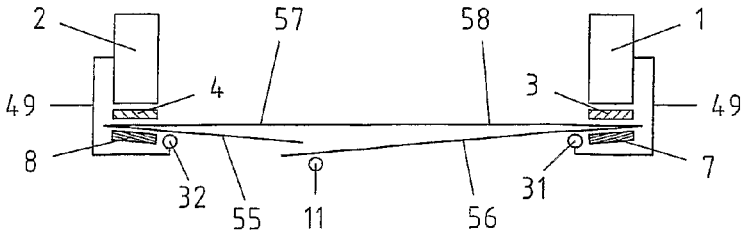

At the end of the support rods 31, 32 and the panel supports 9, 10 and between the same, a guide rod 11 is movably arranged on two shafts 39 transversely to the conveying direction 15 and just in front of the pair of rolls 14, see FIGS. 3, 7 and 8. The guide rod 11 is movable parallel to the pair of rolls 14 by means of a remote-control actuator 40, for example an endless chain running parallel to and at a small distance from the shaft 39 arranged next to the pair of rolls 14. The guide rod 11 slides by means of small wheels arranged on the same (see FIG. 8) towards the rods 39 and is moved along the same by means of said chain which is driven by a motor via a gear, not shown but as known to a person skilled in the art. Especially the lower part of the chain is indicated with reference numeral 40 in FIG. 8. By means of sprockets, the motor and the gear, the guide rod 11 is thus moved sideways by means of the chain into the correct position for optimal guiding of folded corrugated cardboard sheets 18 towards the nip of the pair of rolls 14, cf. FIG. 8. The pair of rolls 14 is stationarily fixed to the stand of the folding unit at the outlet 20 thereof, see FIGS. 2 and 3, and the roll nip is set depending on the sheet thickness and the desired roll pressure.

With the construction of the folding unit described above, its function will now be described.

Figure 4:
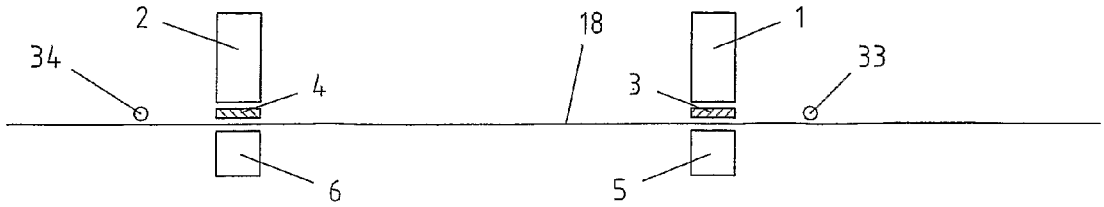
Figure 5:
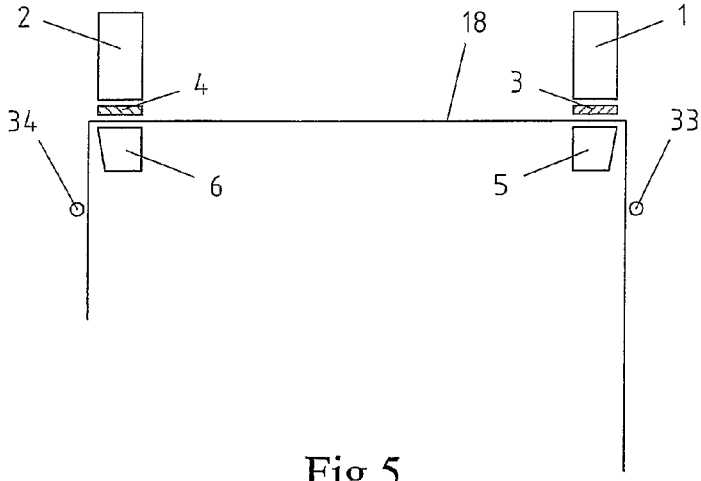

After the above described folding of the outer panels 55, 56 from 0° to 90°, see FIGS. 4 and 5, in the front portion or half of the folding unit in the conveying direction 15 and just behind the section line II-II in FIG. 2, the outer panels 55, 56 are engaged with the respective folding belts 7, 8, between the latter and the cooperating folding rules 5, 6, as shown in FIG. 6, for further successive folding inwards towards the inner panels 57, 58, cf. FIG. 7. When the corrugated cardboard sheet 18 leaves the folding rules 5, 6, which are terminated approximately halfway between the guide rollers 16, 17 as mentioned above, the folding of the outer panels 55, 56 is regulated individually and as required, as will be discussed below, by means of the wheel stands 22, 23 which are settable to regulate the angular setting of the folding belts 7, 8 in their areas. With the corrugated cardboard sheets 18 approaching the rear guide rollers 17, the outer panels 55, 56 have been folded almost 180° towards the inner panels 57, 58. The curved guide rod 11 then catches the folded panels 55, 56 and guides them together with the panels 57, 58 into the nip of the pair of rolls 14, where the glue flap 59 of the outer panel 55 is pressed against and glued to the other outer panel 56. The setting of the guide rod, which takes place sideways depending on the relation of the narrow outer panel of the box to the wide outer panel, has been motorised and is set automatically via the console 21 in the correct position.

The folding belts 7, 8, which control the folding of the outer panels 55, 56 from 90° to 180°, are driven at a speed which is 2-3% higher than the ordinary speed of the machine and are driven by the horizontal guide rollers 17. The turning of the folding belts is partly controlled by setting of the wheel stands 22, 23. This setting was previously manual, see FIG. 9. What determines this setting is whether the boxes are to have an inner or outer glue flap 59 and optimal folding depending on the dimensions of the boxes, which is evident from the change of the angle $\alpha$ (see FIG. 14) at different ratios between the panel widths of the boxes. This setting has involved settings both horizontally and vertically and angling of the belts to ensure optimal folding.

Figure 9:
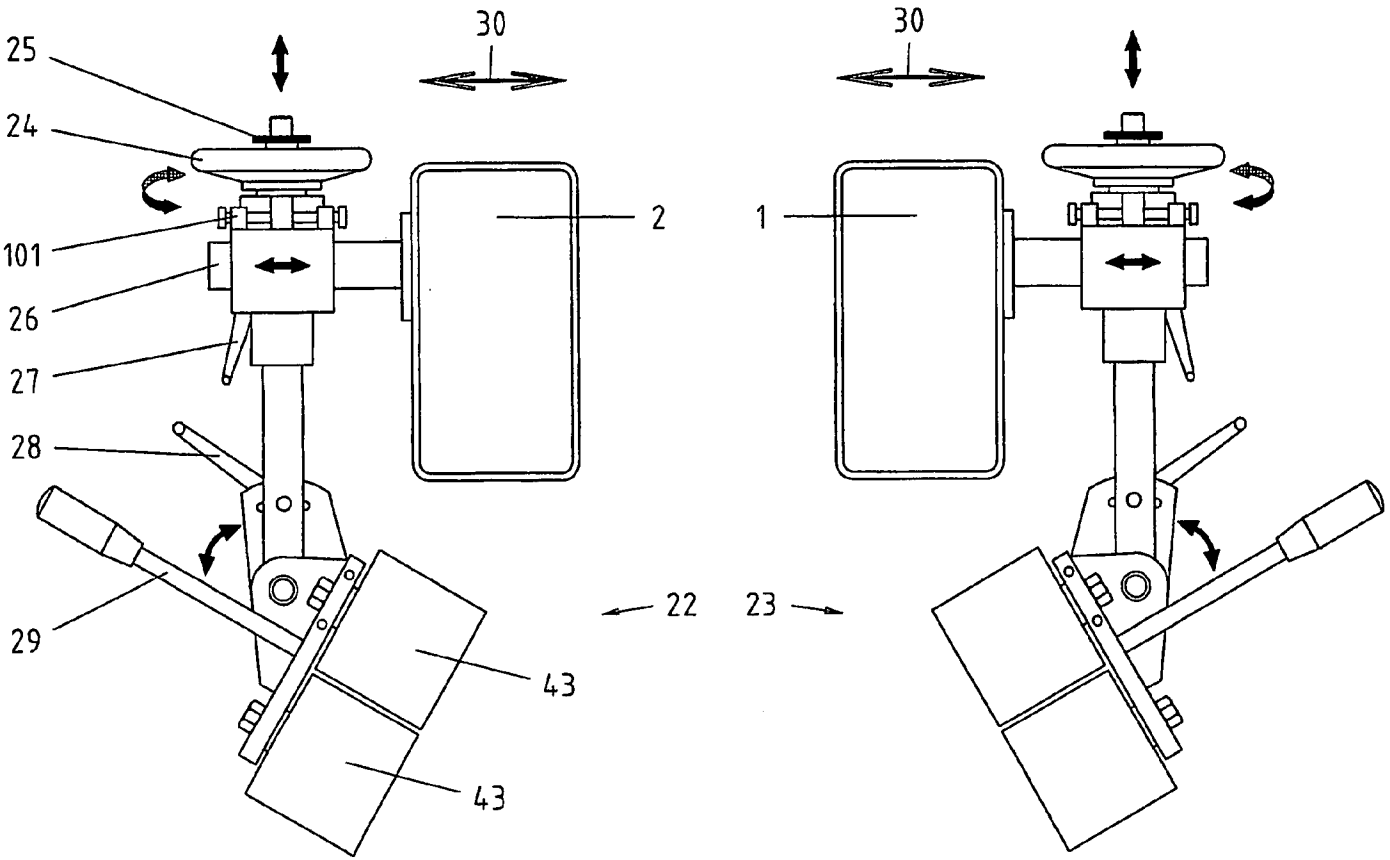
PRIOR ART Fig 9
FIG. 9 illustrates in a section transversely to the conveying direction of the corrugated cardboard sheets and seen towards the pair of rolls, a prior art pair of wheel stands and the mounting thereof in the respective folding beams.

Reference is now made to FIG. 9 which illustrates a prior art, manually settable left-hand and right-hand wheel stand 22, 23. As stated above, the folding beams 1, 2 are adjustable transversely to the conveying direction 15 depending on the dimensions of the corrugated cardboard sheet 18, as indicated by arrows 30. As is evident from the above description of the folding operation, folding occurs along the fold lines 53 between the outer panel 55 and the inner panel 57 and also between the outer panel 56 and the inner panel 58. When setting the wheel stands 22, 23 and, thus, the angle of the folding belts 7, 8 to the inner panels 57, 58, it is therefore most important for the accuracy in folding that folding occurs exactly along the fold lines 53, which means the setting of the wheel stands requires great accuracy.

Referring once more to FIG. 9, each wheel stand 22, 23 according to prior art is movably arranged on a shaft 26 projecting horizontally outwards from the associated folding beam 1, 2 and supports in its lower portion a set of wheels 43, by means of which the angle of the respective folding belts 7, 8 is set. The wheels 43 are raised or lowered by means of an adjusting knob 24 relative to the folding beam and, thus, relative to the corrugated cardboard sheet 18 which is being folded, as indicated by the vertical double arrow in the figure. After setting in the vertical direction, the setting is locked by means of a locking ring 25. The setting in the lateral direction occurs by manual displacement of the wheel stand on the shaft 26, as illustrated by the horizontal double arrow. The locking of the setting occurs by means of a locking lever 27. Setting of the angle for turning or angular setting of the folding belts 7, 8 occurs by means of a turning lever or arm 29, and the locking of the setting is performed by means of a locking lever 28. In some combinations of the above described settings, the folding belts may tend not to be willing to trace correctly. Therefore the setting device 101 can be used to turn the wheel stand about its shaft along which the vertical setting is performed, which is illustrated by the single part-circular arrow above the shaft 26 in FIG. 9.

The actuation exerted on the panels by the turning during the actual folding of the panels increases the chance of optimal folding, the longer the folding distance of the machine. Economic reasons and reasons due to space, however, result in limitation of the length of the folding distance. For optimal folding along the limited length of the folding distance, as smooth a folding movement as possible is necessary, thereby optimally utilising the folding distance. In machines with manual setting, the operator is allowed to set the folding movement. This is a time-consuming operation which also requires knowledge, resulting in more or less optimal settings, with a variation in quality of the folding of the boxes as a direct result.

Figure 11:
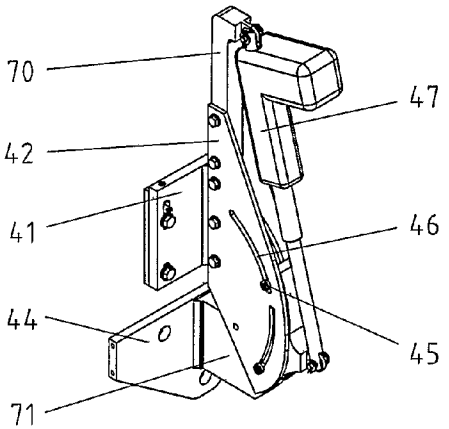
FIG. 11 is a perspective view of the wheel stand according to the invention.
Figure 12:
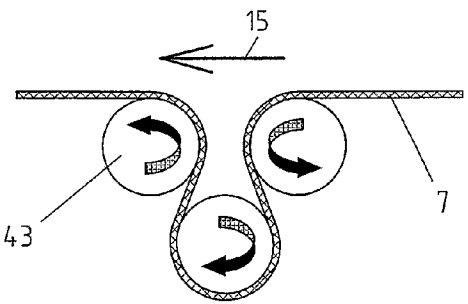
FIG. 12 illustrates in detail the path of the folding belt through the wheel stand.
Figure 10:
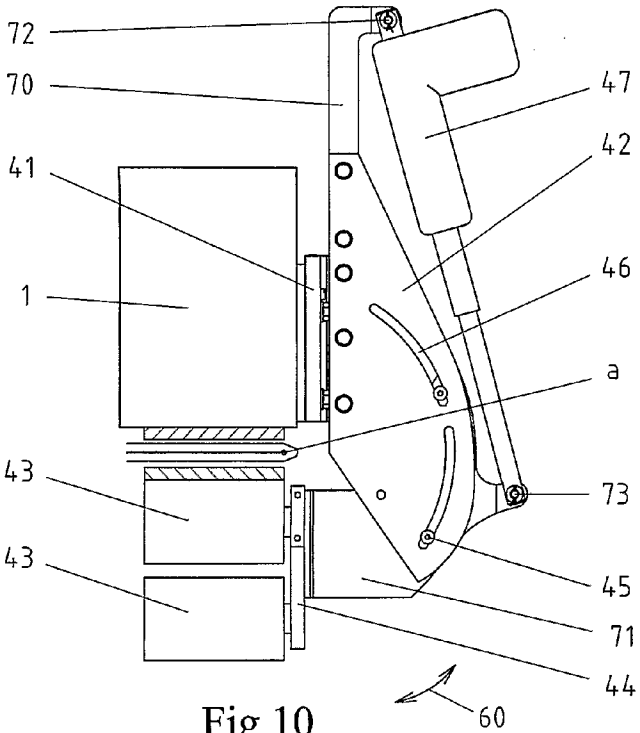
FIG. 10 is a side view of a wheel stand according to the invention mounted on its folding beam and in engagement with a folding belt which is controlled by the wheels thereof.

FIG. 10 illustrates a right-hand wheel stand for the angular setting of the folding belt according to the invention. The wheel stand comprises an attachment 41, by means of which the wheel stand is fixedly attached to the folding beam 2. An upwardly extending arm 70 is fixedly attached to or integrated with the attachment 41, as shown in FIG. 11. At least one vertically oriented guide plate 42 is fixedly attached to the attachment 41 (the arm 70) perpendicular to the folding beam 2. Preferably two arcuate slots or grooves 46 are formed in each guide plate 42, and the slots 46 have a common centre of curvature or point a positioned outside the guide plate/guide plates 42. The wheel stand also comprises a movable or turnable portion or support 44 on which at least one wheel 43 is rotatably supported under the folding beam 2, but three wheels 43 are preferred as shown in FIG. 12. The support 44 comprises, on its side opposite the wheels 43, a vertical, upwardly extending plate 71 which is fixedly attached to or integrated with the support 44 and which is oriented in the same plane as the guide plate 42, as shown in FIG. 11. At least two guide pins 45 project perpendicular from the plate 71, one for each slot 46, by means of which guide pins the support 44 is turnably mounted in the guide plate 42 by the guide pins 45 sliding in the slots 46 as illustrated in FIGS. 10 and 11. This turning movement for angular setting of the wheels 43 is performed by means of an actuator 47, for example a pneumatic cylinder or hydraulic cylinder, whose one end is pivotally fastened to the upper portion of the arm 70 by means of a pivot 72 and whose other, opposite end is pivotally fastened to the outermost portion of the plate 71 by means of a pivot 73. With this construction, the turning point a of the wheel stand will coincide with the fold line 53 between the outer panel 56 and the inner panel 58. The angle between the shafts of the wheels 43 and the conveying belt 8 is usually about 20°, maximum 35°.

FIG. 12 shows the location of the three wheels 43 exemplified in the wheel stand 22. These wheels are preferably cambered. The function of the wheel stand, in addition to affect the turning angle of the folding belt 7, is to guide that part of the belt which contacts the sheets 18 and actively helps to fold the sheet. This is done by the belt having a maximum angle of contact around the respective wheels 43. By the belt contacting the wheels according to FIG. 12, the belt is controlled in such a manner that it does not flutter and is laterally guided so as to be in the correct position relative to the conveying belt 3. This is absolutely necessary since the belt part in contact with the folding belt 7 is about 3500 mm long. To further illustrate the need for such guiding, reference is made to the fact that the folding belt 7 at the inlet is positioned at the side of the folding beam 1 and then, before the outlet, extends parallel to and under the conveying belt 3.

The actuators (30) for adjusting the folding beams 1, 2 transversely to the conveying direction 15, the actuators 47 of the wheel stands 22, 23, the actuators 48 of the panel supports 9, 10, the actuators 40 of the guide rod 11 and the adjusting means of the glue nozzle 35 are all connected to a driving and setting console 21. When in-putting into the driving and setting console the dimensions and properties of the (corrugated) cardboard sheets which are to pass through and be processed in the inline machine, all the units of the machine are automatically set according to the operations that are to be performed and which have been input.

Figure 13:
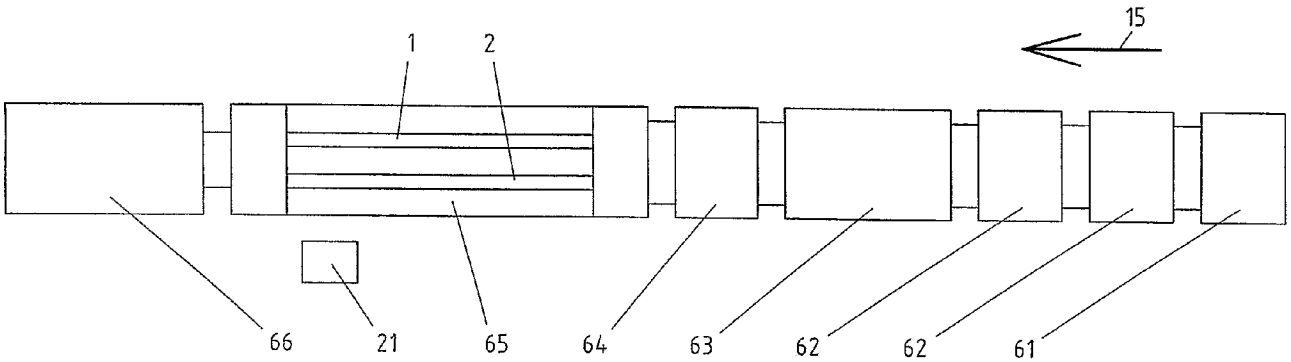
FIG. 13 is a diagram of an inline machine for production of corrugated cardboard boxes and the units included therein and the automisation thereof according to the invention.

FIG. 13 illustrates schematically the construction of an inline machine for producing corrugated cardboard boxes and the units included in the machine and their automisation according to the invention. The setting of the different machinery units, that is feeding device 61, printing unit 62, slitting unit 63, punching unit 64, folding unit 65 and counting or bundling unit 66 are fully motorised and preprogrammable to reduce the change-over times of the machine and also ensure as exact and accurate settings as possible. These settings occur centrally from the driving and setting console 21 and via a connection line to each unit and are readable on a computer display. The setting of the folding unit has up to now been only partly motorised and preprogrammable. It is the setting of the folding in step 2, that is from 90° to 180°, which largely has been manual.

The invention concerns the setting of the machine for optimal folding of the last 90° folding and is characterised in that the settings of the folding movements performed by the machine are motorised and that they are set fully automatically in optimal positions. For each type of box, that is based on the dimensions of the box, a number of motorised devices are set to provide an optimal folding result. The different functions for folding from 90° to 180° according to this description which are included in the invention of a fully automatic system for setting the folding unit are:

- Setting of folding belts by means of the wheel stands
- Panel supports for large panels with automatic setting
- Automatic guiding rod in front of press rolls
- System for setting connected to the machine setting of the dimensions of the boxes using software for settings, which provides optimal folding.

By motorising the settings of the folding movement, an important, exacting and difficult machine setting process has been motorised. To perform the manual setting, the operator was previously forced to enter the area in the folding unit, which in operation was closed for safety reasons. This meant that the machine had to be stopped, which implied considerable losses of time and that the setting of the machine was left to the knowledge and capacity of the operator. The system according to the invention means that the setting of the folding movement for each box blank to be processed is made according to a calculated optimal setting value. Using this setting as a base, the operator can then, as required, make fine adjustments depending on operating conditions, such as speed of the machine and corrugated cardboard grade. By motorising the settings, this can be done in operation in a safe way for the operator. The optimised setting can then, just like all other settings of the machine, be stored in a database to allow the machine, in case of recurrent orders, to be set automatically in previous optimal settings.

Figure 14:
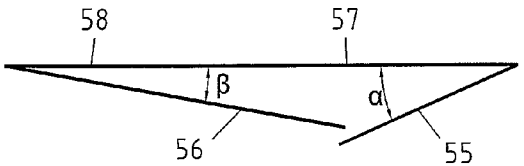
FIG. 14 illustrates the folding of one outer panel over the other.

The angular adjustment and the fine adjustment of the angle of the folding belts to the inner panels 57, 58 by means of the wheel stands 22, 23 in the immediate surroundings of the wheel stands have been discussed above. Each wheel stand is controlled individually by the driving and setting console 21 according to which of the outer panels 55, 56, in their final folding, is to be positioned on the other outer panel 56, 55. Reference is now made to FIG. 14 which illustrates the conditions for a glue flap of a selected outer panel to be folded over the outer panel. In the shown example, the outer panel 55 is a narrow or short panel, while the outer panel 56 is a wide or long panel. As will be easily understood, the sum of the widths of the outer panels 55, 56 equals the sum of the widths of the inner panels 57, 58, and the glue flap 59 is positioned on the outside or inside of the panel 56 as follows (with the glue applied to the side of the glue flap 59 which faces the panel 56). Depending on the location of the wheel stands 22, 23, this a achieved with a certain angular setting. In the current case, a folding movement which is as smooth as possible is achieved in 20° setting of the wheel stands.

When folding the corrugated cardboard sheet 18 so that the short panel 55 will be positioned inside, the wheel stands are set automatically at 20°.

However, if the short panel of the corrugated cardboard sheet should be positioned outside, the settings of the wheel stands 22, 23 are determined according to a calculation, see FIG. 14. $\alpha$ and $\beta$ are calculated according to the cosine law and a safety factor of 10° is added to ⅔ of the angular difference between $\alpha$+10° and $\beta$+10° and is detracted from 20° of the angular setting of the wheel stand on the side that is to be positioned inside. In the embodiment presented above, the angle 20° has been selected, but of course other angles are conceivable for other similar folding units. ⅓ of the difference between $\alpha$+10° and $\beta$+10° is detracted from 20° of the angular setting of the wheel stand on the side that is to be positioned outside. With the result that the small angle is <5°, the two angles are increased to the same extent so that the small angle will be 5°. The control system (console 12) of the machine calculates, based on the above described model, the angular positioning of the wheel stands. With the short panel positioned inside, the wheel stands are consequently set automatically at 20°, and with the short panel positioned outside, an individual setting of each wheel stand occurs in accordance with the above described calculation model. The other setting data also includes the settings of the wheel stands on an HMI display and it will be possible for the operator to finely adjust the setting during operation according to factors such as corrugated cardboard grade and speed. Like all other settings in the HMI of the machine, the final setting can be stored in a database to be used again in case of recurrent orders.

Previous constructions involve manual settings and are also complicated since up to four different settings are necessary to achieve an optimal setting. Such manual settings are completely without mechanical control. This means that the settings are fully dependent on the operator's experience and dexterity. A further aggravating factor is that the settings must occur on a machine that has been stopped (due to safety risks). All these aggravating factors, which add to impaired folding, are eliminated by the new technique which offers opportunities for improved folding.

The folding unit has been described above in con-connection with downward folding of the outer panels of the sheets. As will be easily realised by a person skilled in the art, it is possible, and in some cases desirable, to fold the outer panels upward instead, which is achieved by the different elements of the folding unit, which have been shown to be positioned outside the conveying plane of the sheets, being positioned inverted below, and in relation to, the conveying plane, and vice versa.

Moreover, the sheet has throughout the text been referred as to "corrugated cardboard sheet". Of course, the invention is also applicable to other cardboards than corrugated cardboard.

The invention is not limited to that described above or shown in the drawings, but can be modified within the scope of the appended claims.

The invention claimed is:

1. A folding unit for corrugated cardboard sheets in inline production of corrugated cardboard boxes, the corrugated cardboard sheet having two outermost panels, comprising:

an inlet and an outlet;

a pair of parallel and laterally displaceable folding beams each with an endless conveying belt, the folding beams extend from the inlet of the folding unit to the outlet of the folding unit;

a pair of folding rules which are arranged under the respective folding beams and the pair of folding rules extend from the inlet of the folding unit and towards, but not all the way to the outlet of the folding unit;

a pair of folding rods fixedly positioned outside the respective folding rules and at angle to the respective folding rules, said folding rods being arranged in the folding unit front portion, in the conveying direction of the corrugated cardboard sheets;

a pair of folding belts which are arranged under and cooperate with a respective of the pair of folding rule and extend from an associated guide roller with a vertical shaft at the terminal end of the folding rod in the conveying direction to an associated guide roller with a horizontal shaft substantially adjacent to the outlet;

means for supplying and folding the two outermost panels of the corrugated cardboard sheet from 0° -90° at the inlet of the folding unit and 90° -180° at the outlet of the folding unit;

a pair of wheel stands which are each engaged with the respective folding belts in a position in the conveying direction of the corrugated cardboard sheets after the terminal end of the folding rules and substantially adjacent to the respective folding beams, wherein each of the pair of wheel stand comprises an attachment which is fixedly attached to the associated folding beam and at least one guide plate is fixedly attached perpendicular to the folding beam, at least one wheel rotatably supported by a support, said support is turnably suspended from a pair of vertically arcuate slots in said guide plate by means of a pair of separate guide pins;

means for adjusting an angle of said wheel to the associated conveying belt; and means for fine adjustment of the angular settings of the wheel stand.

2. The folding unit as claimed in claim 1, wherein, the folding unit also comprises a pair of support rods which are resiliently attached to the respective folding beams and have essentially the same extent in the conveying direction as the folding belts and are arranged between the pair of folding belts to support the outermost panels that are being folded.

3. The folding unit as claimed in claim 2, wherein the folding unit also comprises a pair of rod-shaped panel supports which have substantially the same extent in the conveying direction as the folding belts and which by the respective actuators can be pivoted from an inactive position to an active position between the pair of support rods.

4. The folding unit as claimed in claim 1, wherein, the folding unit comprises a guide rod, which by means of an actuator is movably arranged adjacent and parallel to a pair of rolls between the pair of folding beams.

5. The folding unit as claimed in claim 1, wherein the folding unit comprises a glue nozzle with adjusting means, which is arranged in the conveying direction of the corrugated cardboard sheets in front of the folding rods and at a distance outside one folding beam to apply glue to a glue flap which is integrated with one outermost panel to be folded.

6. The folding unit as claimed in claim 1, wherein the actuators for setting the folding beams transversely to the conveying direction, the actuators of the wheel stands the actuators of the panel supports the actuators of the guide rod and the adjusting means of the glue nozzle are connected to said driving and setting console which also controls other units in the inline machine.

7. A method of folding corrugated cardboard sheets in inline production of corrugated cardboard boxes, comprising the steps of:

intermittently feeding corrugated cardboard sheets into a first and second portions of a folding unit during application of glue, wherein said corrugated cardboard sheets comprise two outermost panels and one of said outermost panels is narrower than the other;

successively folding the two outermost panels of the corrugated cardboard sheet from 0° to 90° by means of a pair of folding rules and a pair of folding rods cooperating with said folding rules in the conveying direction of the corrugated cardboard sheet in the first portion of the folding unit;

successively folding the two outermost panels of the corrugated cardboard sheet from 90° to 180° in the conveying direction of the corrugated cardboard sheet in the second portion of the folding unit by means of a pair of folding belts and said pair of folding rules as well as a pair of wheel stands;

setting the angle of each said folding belt to the horizontal plane by means of said pair of wheel stands;

guiding the folded corrugated cardboard sheet by means of guide rod between a pair of rolls for gluing of a glue flap of one folded outermost panel to the other folded outermost panel;

monitoring final folding of the two outermost panels during folding; and positioning the narrow outermost panel inside or outside the other folded outermost panel by finally setting the angle of each folding belt by means of said wheel stands by remote control from a driving and setting console.

8. The method as claimed in claim 7, wherein the two wheel stands are set by means of the driving and setting console for an angle in the range 10° -30° when one folded outermost panel is narrower than the other folded outermost panel and the narrow panel is to be positioned inside the other folded outermost panel.

9. The method as claimed in claim 7 wherein, when one folded outermost panel with its glue flap is narrower than the other folded outermost panel and the glue flap is to be positioned outside the other folded outermost panel and the angle between the narrow panel and the horizontal plane is $\alpha$ and the angle between the wide panel and the horizontal plane is $\beta$, the angular setting of the two wheel stands is performed by means of the driving and setting console in such a manner that ⅓ of the difference between $\alpha$+10° and $\beta$+10° is detracted from the angular setting 20° of the wheel stand which is in contact with the narrow panel.

* * * * *